United States Patent [19]

Harvey

[11] 4,055,019

[45] Oct. 25, 1977

[54] CONSTRUCTIONAL TOY AND ELEMENT THEREFOR

[76] Inventor: Edward Henry Harvey, The Verne, Moor Common, Lane End, Buckinghamshire, England

[21] Appl. No.: 325,056

[22] Filed: Jan. 19, 1973

[30] Foreign Application Priority Data

| | | |
|---|---|---|
| Feb. 3, 1972 | United Kingdom | 5126/72 |
| Mar. 16, 1972 | United Kingdom | 12422/72 |

[51] Int. Cl.[2] ..... A63H 33/08

[52] U.S. Cl. ..... 46/30; 220/315

[58] Field of Search ..... 46/30, 31, 25, 26; 220/315

[56] References Cited

U.S. PATENT DOCUMENTS

| | | | |
|---|---|---|---|
| 2,057,942 | 10/1936 | Fay | 46/16 |
| 2,526,458 | 10/1950 | Bronnenkant | 220/315 |
| 2,743,839 | 5/1956 | Hulterstrum | 220/315 |
| 2,776,521 | 1/1957 | Zimmerman | 46/30 X |
| 3,497,908 | 3/1970 | Zamarra | 220/315 |

FOREIGN PATENT DOCUMENTS

| | | | |
|---|---|---|---|
| 1,525,348 | 4/1968 | France | 220/315 |

*Primary Examiner*—F. Barry Shay

*Attorney, Agent, or Firm*—Larson, Taylor and Hinds

[57] ABSTRACT

A substantially planar element for use in building-up a model structure by hingedly and detachably connecting a plurality of such elements in edge-to-edge relationship, wherein a. the element is of geometric shape having at least one margin, b. said margin comprises at least two projections having a recess therebetween, c. an end face of one projection is formed with a recessed hinge socket, d. an end face of the other or another projection is formed with a protruding hinge pip, e. an end face of one of the projections is an abutment face, f. the margin is adapted to mate with a complementary margin of another such element with the hinge pip of each element sprung into the hinge socket of the other element and with the abutment face abutting the complementary abutment face of the other element so as to maintain the hinge pip of each element in the hinge socket of the other element.

13 Claims, 6 Drawing Figures

CONSTRUCTIONAL TOY AND ELEMENT THEREFOR

Figure 1:
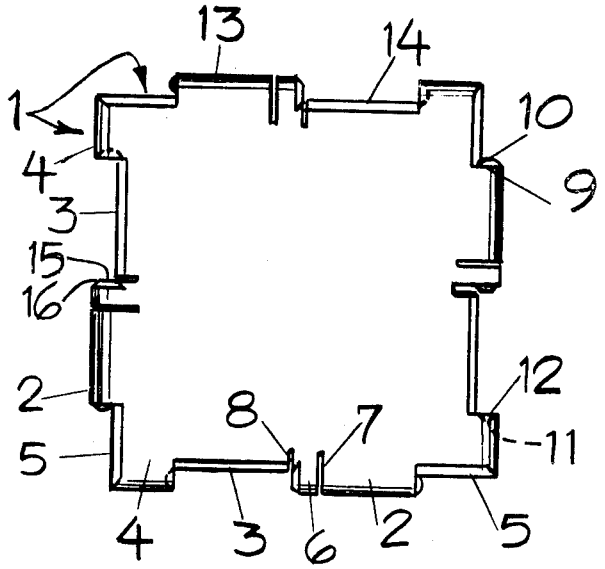

This invention relates to substantially planar elements for use in building-up a structure, particularly a toy or model structure, and to a constructional toy comprising a plurality of such elements.

The invention has as an object to provide a substantially planar element which can be hingedly and detachably connected with like elements in edge-to-edge relationship to build-up a wide variety of structures. The invention also has as an object to provide a constructional toy which comprises a plurality of such elements, which will permit of exercises in solid geometry and which it is believed will prove both absorbing and educational.

The invention provides a substantially planar element for use in building-up a structure by hingedly and detachably connecting a plurality of such elements in edge-to-edge relationship, wherein a. the element is of geometric shape having at least one margin
b. said margin comprises at least two projections having a recess therebetween,
c. an end face of one projection is formed with a recessed hinge socket,
d. an end face of the other or another projection is formed with a protruding hinge pip,
e. an end face of one of the projections is an abutment face,
f. the margin is adapted to mate with a complementary margin of another such element with the hinge pip of each element sprung into the hinge socket of the other element and with the abutment face abutting the complementary abutment face of the other element so as to maintain the hinge pip of each element in the hinge socket of the other element.

Said abutment face is preferably located between said hinge socket and said hinge pip and is preferably located substantially midway between the ends of the margin.

Sufficient resiliency must be provided in the margin to enable the hinge pip of one element to be sprung into the hinge socket of the other element during said mating. To this end, at least one of the said projections may be divided by a slot to provide a resilient tongue which will allow the hinge pip of one element to be sprung into the hinge socket of the other element in said mating and/or at least said margin of the element may be formed from a material having sufficient resilience to enable the hinge pip of one element to be sprung into the hinge socket of the other element. Where a said resilient tongue is provided, an end face of the resilient tongue may comprise said abutment face.

The margin may comprise a single hinge pip which is located towards one end of the margin and a single hinge socket which is located towards the other end of the margin.

The invention also provides a substantially planar element for use in building-up a structure by hingedly and detachably connecting a plurality of such elements in edge-to-edge relationship, wherein a. said element is of geometric shape having two margins at an angle to each other,
b. each said margin is formed with first and second projections spaced apart by a recess of substantially the same width as one of the projections, c. the first projection is substantially at an end of the margin,
d. the second projection is spaced from the other end of that margin by a further recess, the width of which is substantially equal to the width of said first projection,
e. an end face of one projection is formed with a recessed hinge socket,
f. an end face of the other projection is formed with a protruding hinge pip,
g. the two recesses are adapted to receive and mate with the two projections of a complementary margin of another such element,
h. the arrangement is such that, in said mating, the hinge pip of each element can be sprung into the hinge socket of the other element.

The hinge socket may be formed in the inner end face of the first projection and the hinge pip may be formed on the outer end face of the second projection. The inner end face of said second projection may be an abutment face adapted, in said mating, to abut a complementary abutment face of the other element to maintain the hinge pip of each element in the hinge socket of the other element. One of the projections on each margin may be sub-divided by a slot to provide a resilient tongue which, in said mating, allows the hinge pip of each element to be sprung into the hinge socket of the other element. Said slot may be adjacent to the inner end face of the second projection.

An element according to the present invention may be of any suitable geometric form, e.g. may be substantially in the form of a triangle and have three said margins or be substantially in the form of a square and have four said margins.

The element may be formed in any suitable manner and from any suitable material but is preferably moulded from a suitable synthetic plastics material, a particularly suitable synthetic plastics material being an acrylonitrilebutadiene-styrene copolymer.

The element may be of any suitable size with each margin thereof preferably of a same standard length, although one or more margins may be of a different length which may be a whole number multiple of said standard length. Preferably the standard length of one or more margins of the element is from 50 mm. to 75 mm., such standard length being measured between the points where a line drawn through the axis of the hinge pip and hinge socket of the margin intersects with lines drawn through the axes of the hinge pips and hinge sockets of adjacent margins of the element. Where each margin of the element comprises only a single hinge pip and only a single hinge socket, then the distance between the end face in which the hinge socket is formed and the crown of the hinge pip is preferably from 0.5 to 0.8 of said standard length. According to a preferred embodiment of the present invention, which is given by way of example, each margin of the element is of a same standard length of substantially 70 mm., the distance between the end face in which the single hinge socket is formed and the crown of the single hinge pip is substantially 45 mm., the element has a thickness of substantially 3.2 mm., and each margin comprises a said resilient tongue having a width of substantially 4 mm., and divided from a said projection by a slot having a length of substantially 9 mm.

The invention further provides a constructional toy comprising a plurality of elements according to the present invention. Preferably each margin of each element is of a said standard length, although one or more elements may be provided the length of at least one margin of which is of or a multiple of said standard length. The elements may be coloured and different elements may be of different colours.

Figure 2:
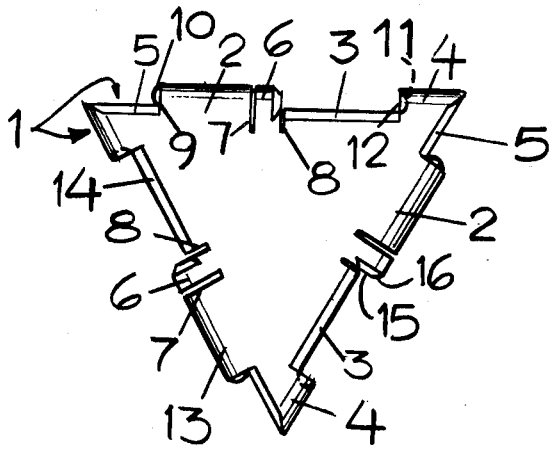
Figure 3:
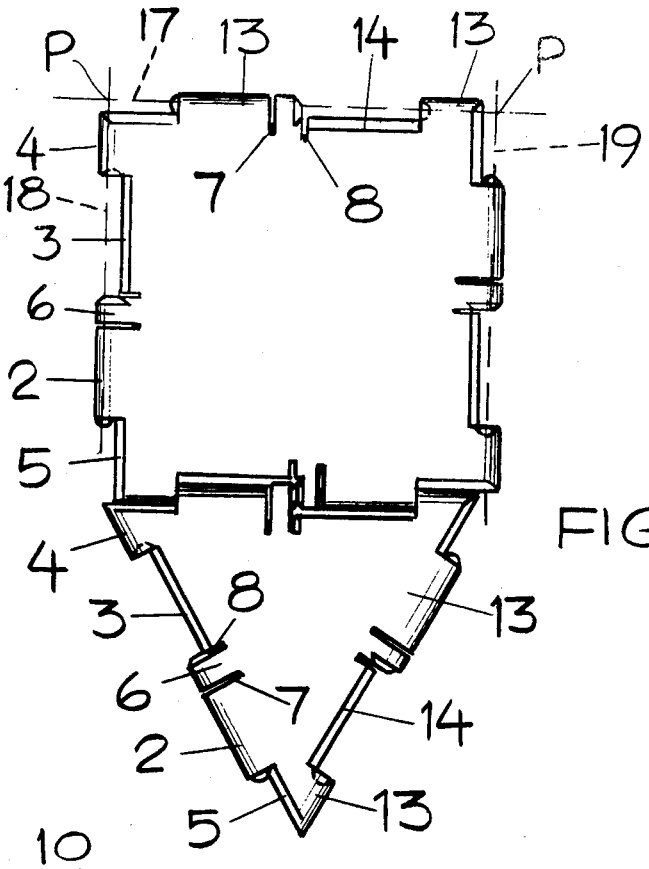
Figure 4:
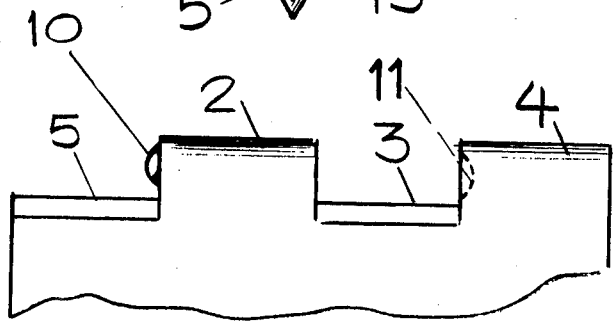
Figure 5:
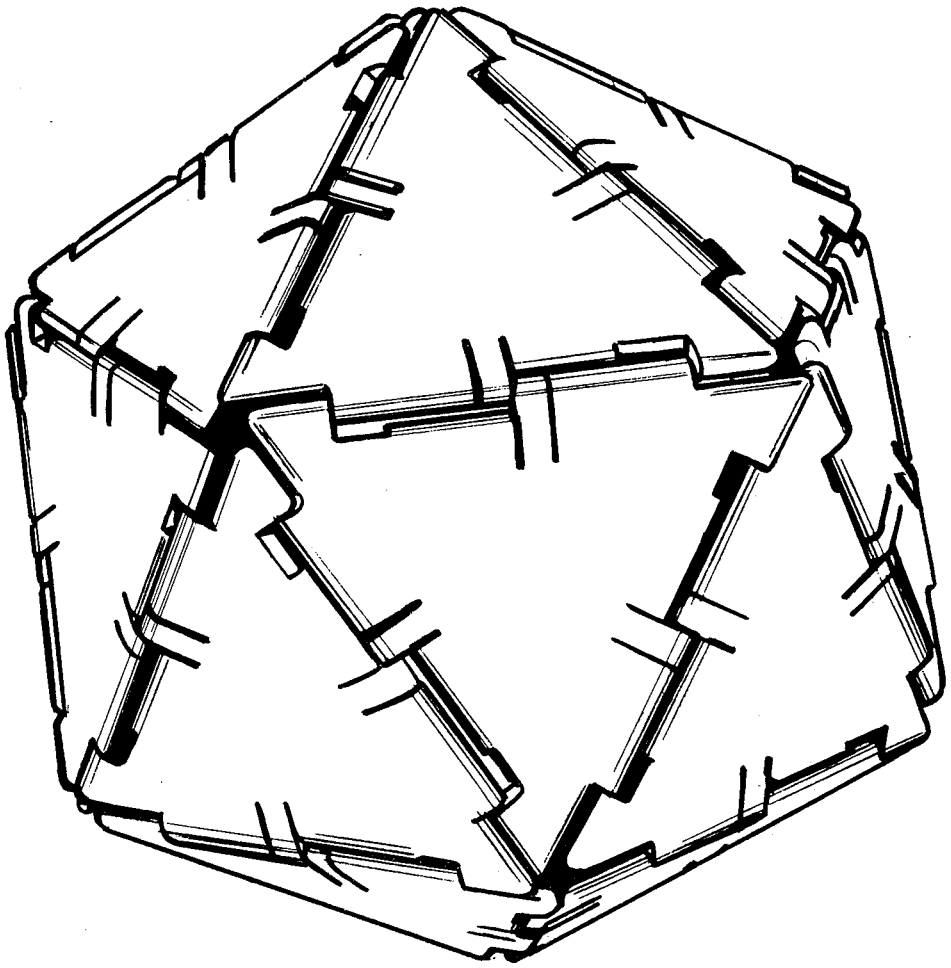
Figure 6:
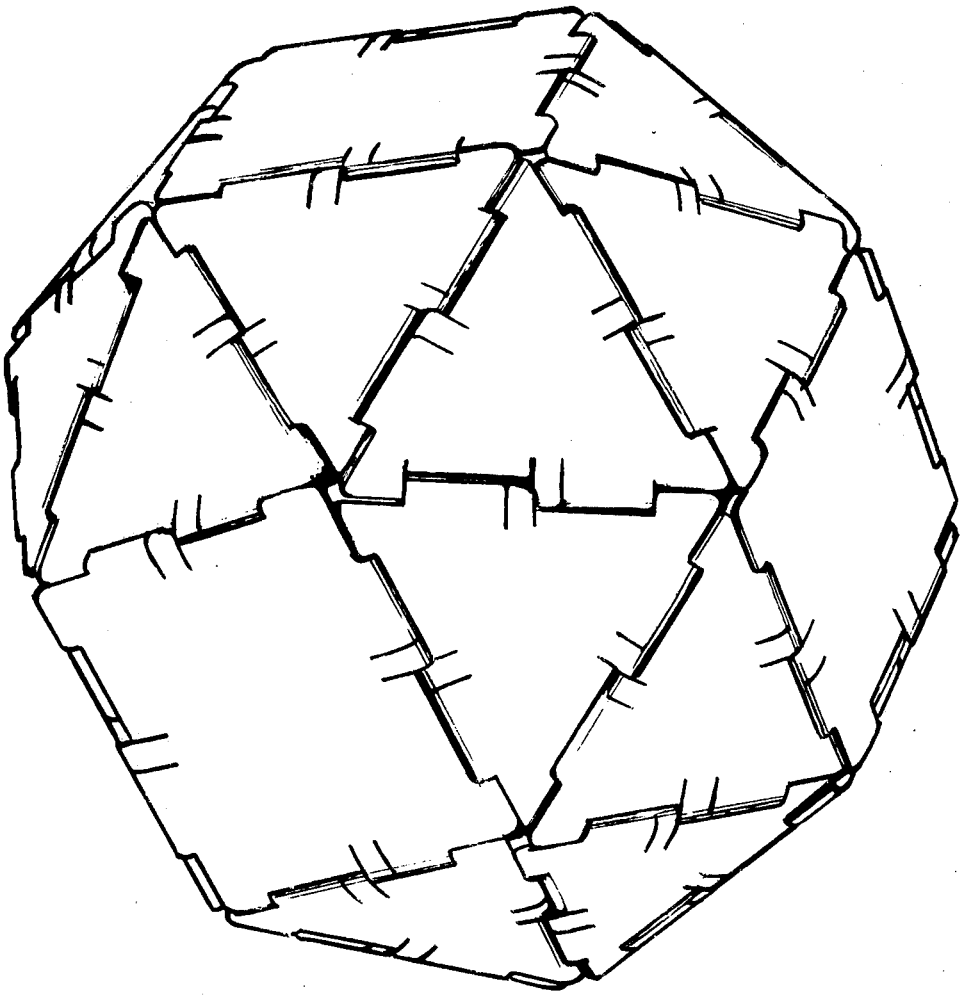

In order that the invention may be the more readily understood reference will hereinafter be made, by way of example, to the accompanying drawings, wherein:

FIG. 1 is a plan view of one embodiment of a substantially square planar element according to the present invention, FIG. 2 is a plan view of a substantially triangular planar element according to the present invention, FIG. 3 is a plan view showing the planar elements of FIGS. 1 and 2 hingedly and detachably connected together in edge-to-edge relationship, FIG. 4 is a fragmentary diagrammatic plan view of another embodiment of planar element according to the present invention, FIG. 5 is a perspective view of an icosahedron assembled from twenty triangular elements as shown in FIG. 2, and FIG. 6 is a perspective view of a snub cube assembled from six square elements as shown in FIG. 1 and thirtytwo triangular elements as shown in FIG. 2.

Referring to FIGS. 1 and 2, it will be seen that each of the margins 1 of each of the planar elements is of substantially the same standard length and comprises a projection 2 and a recess 3 of substantially the same rectangular form. In addition each of the margins 1 comprises a further projection 4 at one end thereof and an open-ended recess 5 at the other end thereof. Each of the projections 2 comprises a resiliently flexible tongue 6 formed by slotting the margins of the elements as shown at 7 and 8. Each tongue 6 has an abutment face 15. The degree of resilience of the tongues 6 can be varied by varying the spacing between each pair of slots 7 and 8 and/or by varying the depth of the slots 7 and 8. The closer together the slots 7 and 8 are to one another, and hence the narrower the tongue 6 therebetween, so the more resilient will the tongue 6 be. Likewise the deeper the slots 7 and 8 are so, once again, the more resilient will be the tongue 6 defined thereby. As will be seen, each of the tongues 6 is at one end of a projection 2. On its opposite end face 9 each of the projections 2 has a part-spherical hinge pip 10 whilst each of the projections 4 has a complementary hinge socket 11 in the end face 12 thereof.

It will thus be readily apparent that the planar elements of FIGS. 1 and 2 can be assembled with one another as shown in FIG. 3 or with other planar elements having similar margins by engaging the projections 2 and 4 of a margin of each in the recesses 3 and 5 of the other. During the course of such engagement the hinge pip 10 of each element will engage in the hinge socket 11 of the other element and the abutment face 15 of each element will abut the abutment face 15 of the other element so as to retain the elements in assembled condition and provide pivots about which the elements can hinge relative to one another. The resilient tongues 6 act to urge the hinge pips 10 into the hinge sockets 11 and to facilitate the assembly and disassembly of the elements.

The tops of the projections 2 and 4 are preferably radiussed as shown at 13 whilst the bottoms of the recesses 3 and 5 are preferably chamferred as shown at 14 so as to increase the angular distance over which the element can be hinged with respect to another element with which it is assembled. In addition the margins of the abutment face 15 of each of the tongues 6 are preferably chamferred as shown at 16 to facilitate the assembly of the element with another element.

Although the resiliently flexible tongue 6 of each margin 1 has been shown as being at that end of each projection 2 opposite the end face 9 thereof it will be readily appreciated that the tongue 6 could be elsewhere on the margin 1, i.e. could be at that end of the projection 2 adjacent the end face 9 or could even comprise part of the projection 4. It will also be appreciated that only the slot 7 is necessary to define each of the resiliently flexible tongues 6, the slots 8 in the illustrated embodiments serving only to increase the flexibility of the tongues 6.

Each of the margins of the elements shown in FIGS. 1 and 2 is of the said standard length of 70 mm., the standard length being measured between the points where a line drawn through the axis of the hinge pip 10 and hinge socket 11 of the margin intersects with lines drawn through the axes of the hinge pips 10 and hinge sockets 11 of adjacent margins as indicated by the points P in FIG. 3 where the broken line 17 intersects the broken lines 18, 19. The elements have a thickness of 3.2 mm., the distance between the end face 12 containing the hinge socket 11 and the crown of the hinge pip 10 of each margin is 45 mm., the resilient tongues 6 have a width of 4 mm. and each of the slots 7 has a length of 9 mm.

The elements shown in FIGS. 1 and 2 are preferably moulded, e.g. injection moulded, from suitable synthetic plastics material. A particularly suitable plastics material is an acrylonitrile-butadiene-styrene copolymer.

The embodiment of FIG. 4 is substantially the same as that shown in FIGS. 1 and 2 except that the tongues 6 have been omitted and instead at least the margins of the element are formed from a material having sufficient resilience to enable the hinge pip 10 of each of two elements being assembled together to be sprung into the hinge socket 11 of the other element. A suitable resilient material for the element is a suitable synthetic plastics material such as polypropylene.

Planar elements according to the present invention can be assembled together in edge-to-edge relationship to build a wide variety of structures. Thus, for example, twenty triangular planar elements of the kind shown in FIG. 2 can be assembled together to form an icosahedron as shown in FIG. 5 whilst six square elements as shown in FIG. 1 and thirtytwo triangular elements as shown in FIG. 2 can be assembled together to form a snub cube as shown in FIG. 6.

What I claim is:

1. A substantially planar element for use in building-up a structure by hingedly and detachably connecting a plurality of such elements in edge-to-edge relationship, wherein a. said element is of geometric shape having two margins at an angle to each other, b. each said margin is formed with first and second projections spaced apart by a recess of substantially the same width as one of the projections, c. the first projection is substantially at an end of the margin, d. the second projection is spaced from the other end of that margin by a further recess, the width of which is substantially equal to the width of said first projection, e. an end face of one projection is formed with a recessed hinge socket in the shape of a portion of a sphere, f. an end face of the other projection is formed with a shallow protruding hinge pip also in the form of a portion of a sphere to mate with said socket, g. the two recesses are adapted to receive and mate with the two projections of a complementary margin of another such element, h. the arrangement is such that, in said mating, the hinge pip of each element can be sprung into the hinge socket of the other element, i. an end face of one of the projections is an abutment face matable with an identical abutment face of another such element in a plane essentially perpendicular to the said margin, said abutment face located along said margin between said socket and said pip, and j. said projection having the abutment face including means for providing sufficient resiliency therein to maintain the hinge pip of each element in the hinge socket of the other element and to permit removal of both hinge pips from their respective sockets by resiliently moving the elements to move the abutment faces toward one another, said means for providing resilience including a slot formed in one of the projections of each margin, providing a resilient tongue which, in said mating, allows the hinge pip of each element to be sprung into the hinge socket of the other element.

2. An element according to claim 1, having the hinge socket formed in the inner end face of the first projection and the hinge pip formed on the outer face of the second projection.

3. An element according to claim 1, wherein the inner end face of said second projection of each element forms said abutment face and is adapted, in said mating, to abut a complementary abutment face of the other element to maintain the hinge pip of each element in the hinge socket of the other element.

4. An element according to claim 1, wherein said slot is adjacent to the inner end face of the second projection.

5. An element according to claim 1, wherein each abutment face is located substantially midway between the ends of its margin.

6. An element according to claim 1, wherein an end face of each said resilient tongue comprises said abutment face.

7. An element according to claim 1, wherein the element is substantially in the form of a triangle and has three said margins.

8. An element according to claim 1, wherein the element is substantially in the form of a square and has four said margins.

9. An element according to claim 1, moulded from synthetic plastics material.

10. An element according to claim 9, wherein the synthetic plastics material is an acrylonitrile-butadiene-styrene copolymer.

11. A substantially planar element for use in building-up a structure by hingedly and detachably connecting a plurality of such elements in edge-to-edge relationship, wherein a. the element is substantially in the form of a triangle and has three margins, b. each said margin comprises at least two projections having a recess therebetween, an end face of one projection is formed with a shallow recessed hinge socket in the shape of a portion of a sphere, an end face of the other projection is formed with a protruding hinge pip also in the shape of a portion of a sphere to mate with the socket, an end face of one of the projections is an abutment face matable with an identical abutment face of another such element in a plane essentially perpendicular to the said margin, said abutment face located along said margin between said socket and said pip, and c. the margin is adapted to mate with a complementary margin of another such element with the hinge pip of each element sprung into the hinge socket of the other element and with the abutment face abutting the complementary abutment face of the other element along said plane, the projection of each margin having the abutment face including means for providing sufficient resiliency therein to maintain the hinge pip of that margin in the hinge socket of the other element and to permit removal of both hinge pips from their respective sockets upon resilient urging of the abutment faces in a direction towards one another, said means for providing sufficient resiliency including a slot dividing at least one projection to form a resilient tongue which, in said mating, allows the hinge pip of one element to be sprung into the hinge socket of the other element.

12. An element according to claim 11, wherein the element is substantially in the form of an equilateral triangle.

13. A substantially planar element for use in building-up a structure by hingedly and detachably connecting a plurality of such elements in edge-to-edge relationship, wherein a. the element is substantially in the form of a square and has four margins, b. each said margin comprises at least two projections having a recess therebetween, an end face of one projection is formed with a shallow recessed hinge socket in the shape of a portion of a sphere, an end face of the other projection is formed with a protruding hinge pip also in the shape of a portion of a sphere to mate with the socket, an end face of one of the projections is an abutment face matable with an identical abutment face of another such element in a plane essentially perpendicular to the said margin, said abutment face located along said margin between said socket and said pip, and c. the margin is adapted to mate with a complementary margin of another such element with the hinge pip of each element sprung into the hinge socket of the other element and with the abutment face abutting the complementary abutment face of the other element along said plane, the projection of each margin having the abutment face including means for providing sufficient resiliency therein to maintain the hinge pip of that margin in the hinge socket of the other element and to permit removal of both hinge pips from their respective sockets upon resilient urging of the abutment faces in a direction towards one another, said means for providing sufficient resiliency including a slot dividing at least one projection to form a resilient tongue which, in said mating, allows the hinge pip of one element to be sprung into the hinge socket of the other element.

* * * * *